US010072911B2

(12) United States Patent
Horch

(10) Patent No.: US 10,072,911 B2
(45) **Date of Patent: *Sep. 11, 2018**

(54) BULLET FRAGMENT COLLECTION TRAY

(71) Applicant: Action Target Inc., Provo, UT (US)

(72) Inventor: Chad Horch, Lehi, UT (US)

(73) Assignee: Action Target Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/867,476

(22) Filed: Jan. 10, 2018

(65) Prior Publication Data

US 2018/0149452 A1 May 31, 2018

Related U.S. Application Data

(63) Continuation of application No. 15/388,926, filed on Dec. 22, 2016, now Pat. No. 9,897,420.

(60) Provisional application No. 62/279,158, filed on Jan. 15, 2016.

(51) Int. Cl.
*F41J 13/00* (2009.01)
*F41J 13/02* (2009.01)

(52) U.S. Cl.
CPC ..... *F41J 13/00* (2013.01); *F41J 13/02* (2013.01)

(58) Field of Classification Search
CPC ..... F41J 13/00; F41J 13/02
USPC ..... 273/403–410
See application file for complete search history.

(56) References Cited

U.S. PATENT DOCUMENTS

| | | | | |
|---|---|---|---|---|
| 2,535,280 | A | 12/1950 | Gartrell | |
| 4,509,301 | A | 4/1985 | Head | |
| 4,786,059 | A | 11/1988 | Barini | |
| 4,819,946 | A | 4/1989 | Kahler | |
| 5,259,291 | A | 11/1993 | Wilson | |
| 6,311,980 | B1 | 11/2001 | Sovine | |
| 6,543,778 | B2 | 4/2003 | Baker | |
| 9,651,344 | B1 | 5/2017 | Chiu | |
| 9,897,420 | B2 * | 2/2018 | Horch | F41J 13/00 |
| 2011/0233870 | A1 | 9/2011 | Oh | |
| 2012/0181752 | A1 | 7/2012 | Bavaro | |
| 2013/0187336 | A1 | 7/2013 | Dreiband | |
| 2016/0003584 | A1 | 1/2016 | Durynski | |
| 2016/0116260 | A1 | 4/2016 | Oh | |
| 2017/0205211 | A1 | 7/2017 | Horch | |

* cited by examiner

*Primary Examiner* — Mark Graham
(74) *Attorney, Agent, or Firm* — Durham Jones & Pinegar; Randall B. Bateman; Christopher L. Wight

(57) ABSTRACT

A bullet fragment collection tray is disclosed that is mounted to a bullet trap by means of hinge at a first end and a releasable latch at a second end, to facilitate removal and collection of bullet fragments that drop into the collection tray from the bullet trap during target practice.

20 Claims, 15 Drawing Sheets

BULLET FRAGMENT COLLECTION TRAY

BACKGROUND OF THE INVENTION

The present invention relates to a bullet fragment collection tray for collecting and disposing of bullet fragments that have impacted and been stopped by a bullet trap.

In order to maintain their proficiency with various types of firearms, law enforcement officers and others routinely engage in target practice. Because of safety concerns relating to ricocheting of bullets, containment of bullet fragments, and release of lead from bullet fragments into the environment when a bullet fragments upon impact, firing ranges increasingly use bullet traps to stop and capture bullets and bullet fragments. Bullets may be recycled or otherwise disposed of in accordance with environmental regulations, thereby significantly reducing the risks of lead escaping into the environment.

A typical bullet trap comprises a heavy gauge steel back plate that primarily functions to stop the bullet, but also enables collection of the bullet fragments. For safety purposes, a bullet trap may also include such features as a self-sealing resilient rubber panel covering the front of the back plate, which serves to capture the bullet and bullet fragments, as well as preventing bullet fragments from ricocheting or back splattering and injuring shooters. Bullet traps may also include edge shields, which also function to prevent side splattering and assist in collection of bullet fragments. Bullet fragments captured by such bullet traps are trapped between the back plate and the rubber panel, and eventually drop down through an opening between the back plate and the rubber panel at the bottom, and then collected in a collection tray.

SUMMARY OF THE INVENTION

The present invention generally relates to an improvement in bullet trap collection trays used in bullet trap devices.

PROVIDE CLAIMS SUMMARY

BRIEF DESCRIPTION OF THE DRAWINGS

The above and other objects, features and advantages of the invention will become apparent from a consideration of the following detailed description presented in connection with the accompanying drawings in which.

Figure 1:
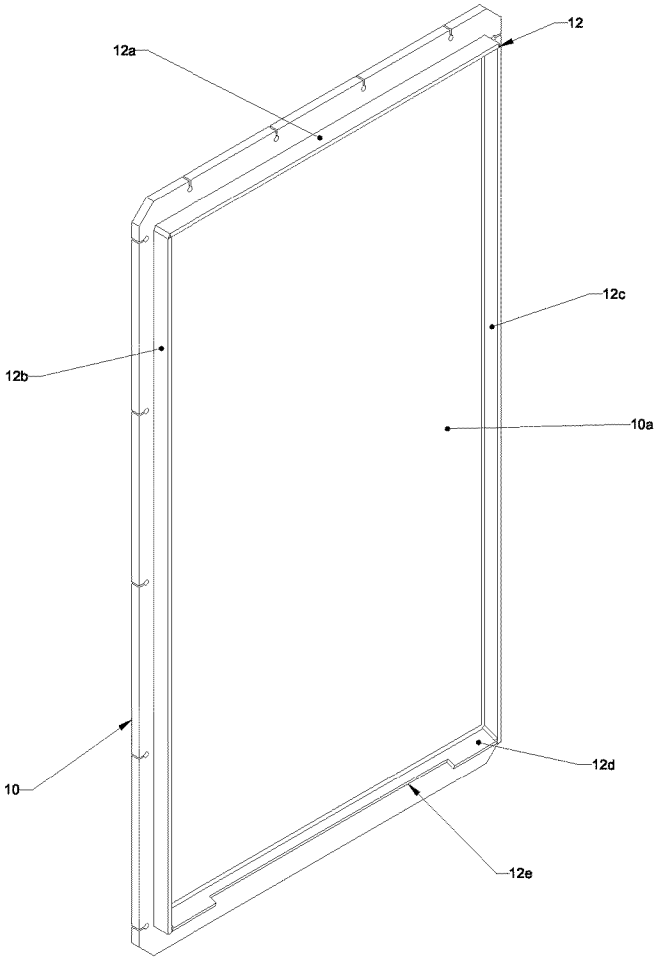
FIG. 1 shows a bullet trap back plate with edge shields and an opening at the bottom.

It is appreciated that not all aspects and structures of the present invention are visible in a single drawing, and as such multiple views of the invention are presented so as to clearly show the structures of the invention.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims. Additionally, it should be appreciated that the components of the individual embodiments discussed may be selectively combined in accordance with the teachings of the present disclosure. Furthermore, it should be appreciated that various embodiments will accomplish different objects of the invention, and that some embodiments falling within the scope of the invention may not accomplish all of the advantages or objects which other embodiments may achieve.

The present invention is generally directed to a bullet fragment collection tray for collecting and disposing of bullet fragments that have impacted and been stopped by a bullet trap. The bullet fragment collection tray of the present invention may generally be used in conjunction with a bullet trap that is used for stopping the trajectory of a bullet and accumulating or collecting bullet fragments that have impacted the bullet trap.

The bullet traps with which the bullet fragment collection tray of the present invention may be used may be of any one of various configurations. One particular configuration of a bullet trap may comprise a back plate of sufficiently heavy gauge steel that it is able to stop the trajectory of various calibers of ordnance intended to be used with the bullet trap and withstand repeated impacts over the life of the bullet trap. Such bullet traps will be configured to stop the trajectory of bullets and other ordnance and collect bullet fragments resulting from the impact of the bullet with the back plate. In some particular embodiments, bullet traps will include some means for preventing ricocheting or back splatter of bullet fragments, such as a self-sealing resilient panel made of a material such as rubber, which covers the front of the back plate. The self-sealing resilient panel also functions to collect bullet fragments between the back panel and the self-sealing resilient panel, where the bullet fragments can then drop down through an opening and be collected in a bucket or tray. Other particular configurations of bullet traps are possible and it is intended that the bullet fragment collection tray of the present invention may also be used in conjunction with such other configurations. For example, instead of a self-sealing resilient panel, wood or other pliable material may be used to prevent back splatter, though such materials may not have a sufficiently long lifespan for suitable use in commercial or high use applications, nor may such materials be sufficient to safely prevent back splatter.

In one particular embodiment illustrated in the drawings, the bullet trap of the present invention may comprise a back plate made of heavy gauge steel having a perimeter and front side. An edge shield may be disposed on the front side of and around the perimeter of the back plate to prevent side splatter and assist in containment and collection of bullet fragments. The bottom portion of the edge shield may be configured to allow bullet fragments to drop past the edge shield, such as by being angled downwardly away from the back plate, so as to facilitate sloughing or sliding of any bullet fragments that may fall onto the edge shield (rather than being caught on an edge shield that would be mounted perpendicular to the back plate, which would collect bullet fragments and not allow them to slide off). In some embodiment, the bottom portion of the edge shield may have an opening through which bullet fragments can pass through and fall into the bullet fragment collection tray.

In some embodiments, the bullet trap may also include a self-sealing resilient panel covering at least a portion of the front side of the back plate within the perimeter of the edge shield. The self-sealing resilient panel may be made of any suitable material that is capable of allowing bullets to penetrate at high velocity, but then close up behind the bullet to prevent back splatter of bullet fragments that might ricochet back at a lower velocity. Such self-sealing resilient materials may include, for example, rubber, silicone, or other plastic polymers.

The self-sealing resilient panel also forms a space between the back plate, edge shield and self-sealing resilient panel. Typically, the self-sealing resilient panel will not be glued to the back panel, since it is desirable to allow some space between the resilient panel and the back plate where bullet fragments may accumulate and drop down into a collection tray. The space between the resilient panel and the back plate defines a temporary bullet fragment collection chamber where such bullet fragments may accumulate and eventually drop down through the space to a bottom opening through which bullet fragments trapped in the bullet fragment collection chamber may exit and be collected by the bullet fragment collection tray.

In one particular embodiment of the of the present invention, the bullet fragment collection tray is mounted to a bottom of the bullet trap beneath the bullet fragment exit of the bullet trap, which bullet fragment exit is formed by an opening at the bottom portion between the back plate and the resilient panel.

In one embodiment, the bullet fragment collection tray is mounted to the bullet trap via a hinge at a first end, has a releasable latch at a second end and has a top opening configured to receive bullet fragments. As used herein, the term hinge is intended to encompass any suitable means for allowing the bullet fragment tray to be flexibly mounted to the bullet trap, such that one end of the bullet fragment tray may be lowered, while another end (the end on which the hinge is mounted) is not lowered, thereby allowing any bullet fragment contents within the bullet fragment tray to slide out by force of gravity when one end is lowered.

In some embodiments, the bullet fragment collection tray may be mounted beneath and extend along the bottom portion of the edge shield. The collection tray may include a bottom side, a front side, a back side, a first end, a second end, and a top opening for receiving bullet fragments. The first end of the bullet fragment collection tray is mounted via a hinge to the bottom of the bullet trap via the perimeter channel (to which the self-sealing resilient panel is attached), the back plate or the edge shield. The second end of the bullet fragment tray has a releasable latch configured to releasably connect the second end of the collection tray to an opposite end of the bottom of bullet trap, via the perimeter channel, the back plate or the edge shield during bullet fragment collection and to disconnect in order to lower the second side downwardly. Lowering of one end allows bullet fragments collected in the bullet fragment collection tray to slide out of the second end of the bullet fragment collection tray for disposal.

In some embodiments, the second end of the bullet fragment tray may have a side that is angled outwardly to facilitate sliding of bullet fragments out of the second end of the bullet fragment collection tray when the releasable latch is released and the second end is lowered. The angle of the side need only be sufficient to allow bullet fragments to slide out of the tray when one end of the tray is lowered.

In other embodiments, the bullet fragment collection tray may also comprise a top plate covering a portion of the top opening, wherein the top plate is angled downwardly from a rear side toward and terminating at a middle portion of the bullet fragment collection tray, so as to direct bullet fragments falling on the top plate into the bullet fragment collection tray. The top plate may, for example, comprise an extension of the rear side of the collection tray, with a portion of the extension being bent forward to create a lip over a portion of the collection tray. In some embodiments, the bullet fragment collection tray and the top plate may be manufactured from a single piece of material, which is then bent such that the rear side of the collection tray extends upwardly and is bent to form a lip which constitutes the top plate. The lip may be bent such that the top plate is angled downwardly so as to promote sliding of bullet fragments off of the top plate and into the collection tray.

In some embodiments, the top plate covering the portion of the top opening of the collection tray may also comprise a shield plate covering at least a portion of the top plate that is exposed to bullet impacts. The shield plate is intended to protect the top plate of the collection tray from bullet impacts, which top plate may be made of a thinner gauge material (i.e., the same material from which the collection tray is made). In another embodiment, another shield plate may also cover the front side of the bullet fragment collection tray so as to protect the front side of the collection tray from bullet impacts.

In other embodiments, the bullet fragment collection tray further comprises a resilient gasket disposed on the shield plate and configured to form a seal between the bullet fragment tray and the bullet trap. The resilient gasket may be disposed between and abut the bullet fragment collection tray and one or more of the back plate and edge shield. The resilient gasket may be made of any suitable material that is flexible and is able to prevent bullet fragments and/or lead dust from such bullet fragments, from falling between the back portion of the collection tray and the front side of the back plate, which could contribute to unwanted lead dust falling through the bullet trap to the floor and disseminating into the environment.

In yet another embodiment of the invention, the bottom portion of the edge shield (at the bottom perimeter of the back plate) is angled downwardly from the back plate toward a middle portion of the bullet fragment tray so as to direct bullet fragments into the bullet fragment collection tray. The downward angling of the bottom portion of the edge shield functions to direct bullet fragments falling from the bottom opening between the resilient panel and the back plate into a middle portion of the bullet fragment collection tray.

In yet another embodiment, the bullet trap further comprises a perimeter channel configured to be mounted to a backside of the self-sealing resilient panel and to the back plate. The perimeter channel is configured as a C-shaped channel. The self-sealing resilient panel can be attached on the front side of the perimeter channel, and the back side of the perimeter channel can be attached to the back plate having the edge shield inside its perimeter. In this configuration, the self-sealing resilient panel abuts against the front edges of the edge shield, forming a space between the self-sealing resilient panel and the back plate equal to the height of the edge shield on the backplate. In one embodiment, the bullet fragment tray hinge is mounted to the perimeter channel. It is understood that in other embodiments the bullet fragment tray could be mounted to the edge shield or directly to the back plate.

As described herein and shown in the figures herein, the various embodiments of the present invention are directed to bullet trap systems for trapping and collecting bullet fragments. In particular, the present invention relates to bullet fragment collection trays. Some embodiments described herein illustrate the use of a bullet fragment collection tray used in conjunction with a portable bullet trap comprising a heavy duty steel back plate, an edge shield and a self-sealing rubber resilient panel covering the front side of the back plate. Such bullet trap systems may be supported on wheeled structures to make them moveable within an area used for target practice, such as inside a tactical gun house that simulates a home, office or building environment where law enforcement or military personnel may practice their shooting.

One particular embodiment of the present invention is shown in FIGS. 1-15, described below. FIG. 1 shows a bullet trap back plate 10 having a front side 10*a* and an edge shield 12 positioned around the perimeter of the back plate front side 10*a*. The edge shield 12 is comprised of top edge shield 12*a*, left edge shield 12*b*, right edge shield 12*c* and bottom edge shield 12*d*. The bottom edge shield 12*d* is shown with a cutout portion that forms an opening 12*e*, through which bullet fragments can drop and pass through, and fall onto the top plate 26 (as shown in FIGS. 7 and 8) of the bullet fragment tray and then into the interior of the bullet fragment collection tray. Edge shields 12*a*, 12*b*, 12*c* and 12*d* provide a complete seal with and around the perimeter of the self-sealing resilient panel 11. Thus, the self-sealing resilient panel 11 fully covers and encloses the striking face of the trap to prevent splatter from bullets and bullet fragments exiting at a high velocity.

Figure 2:
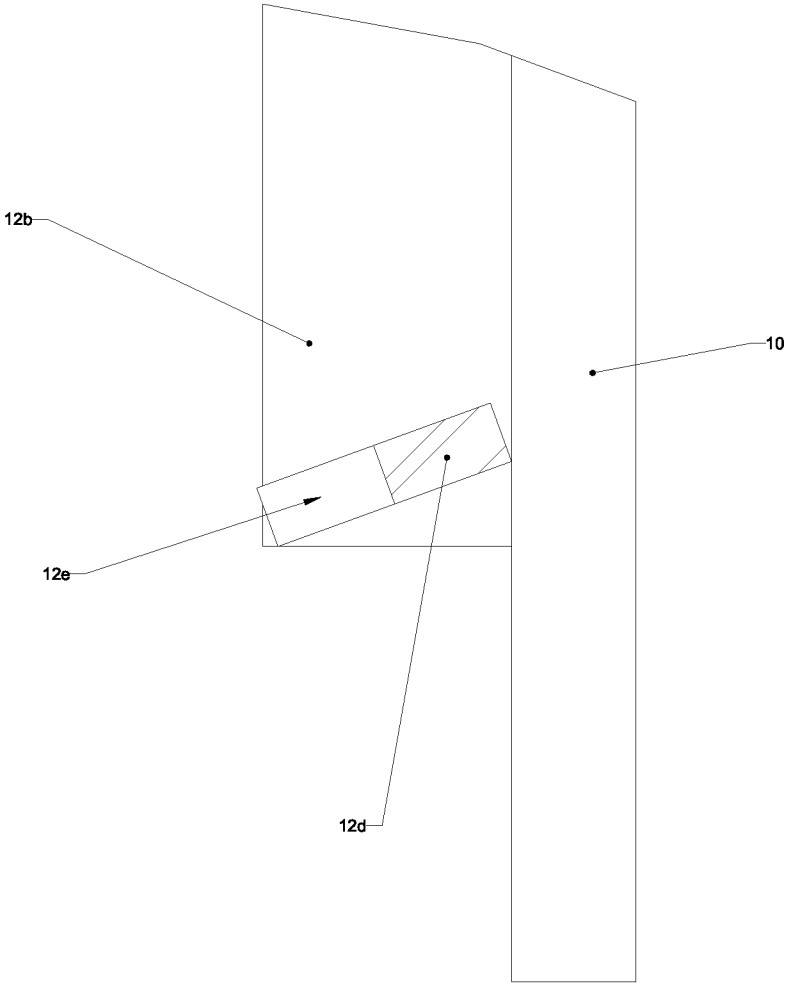
FIG. 2 shows a side cutaway view of the backplate and edge shield.

FIG. 2 shows a side view of the bottom portion of the back plate 10, side edge shield 12*b*, and bottom edge shield 12*d*. The bottom edge shield 12*d* is shown angled downwardly from the back plate toward a middle portion of the bullet fragment tray (not shown) so as to direct bullet fragments into the bullet fragment collection tray. The opening 12*e* is also shown.

FIGS. 3-9 show details of the bullet fragment collection tray 20, which is to be mounted beneath and extending along the bottom of the bullet trap under the seal between the self-sealing resilient panel 11 and the shield 28*a* where bullet fragments are ejected into the interior of the collection tray. The bullet fragment collection tray 20 is shown with a bottom 22*e*, a front side 22*a*, a back side 22*b*, a first end 22*c*, a second end 22*d*, and a top opening 23 for receiving bullet fragments. The first end 22*c* of the bullet fragment collection tray is mounted via a hinge 25 (shown in FIGS. 11-14) to the bullet trap, for example, on the left perimeter channel 15*a*. The second end of the bullet fragment tray has a releasable latch 27 that is configured to releasably connect the second end of the collection tray to the bullet trap, for example, to the right perimeter channel (15*b*) during bullet fragment collection (FIG. 11), and to disconnect in order to lower the second side downwardly and allow bullet fragments collected in the bullet fragment collection tray 20 to slide out of the second end of the bullet fragment collection tray for disposal (FIG. 12).

As shown in FIGS. 3-6, the second end 22*d* of the bullet fragment tray has a side that is angled outwardly to facilitate sliding of bullet fragments out of the second end of the bullet fragment collection tray when the releasable latch is released and the second end is lowered.

Figure 3:
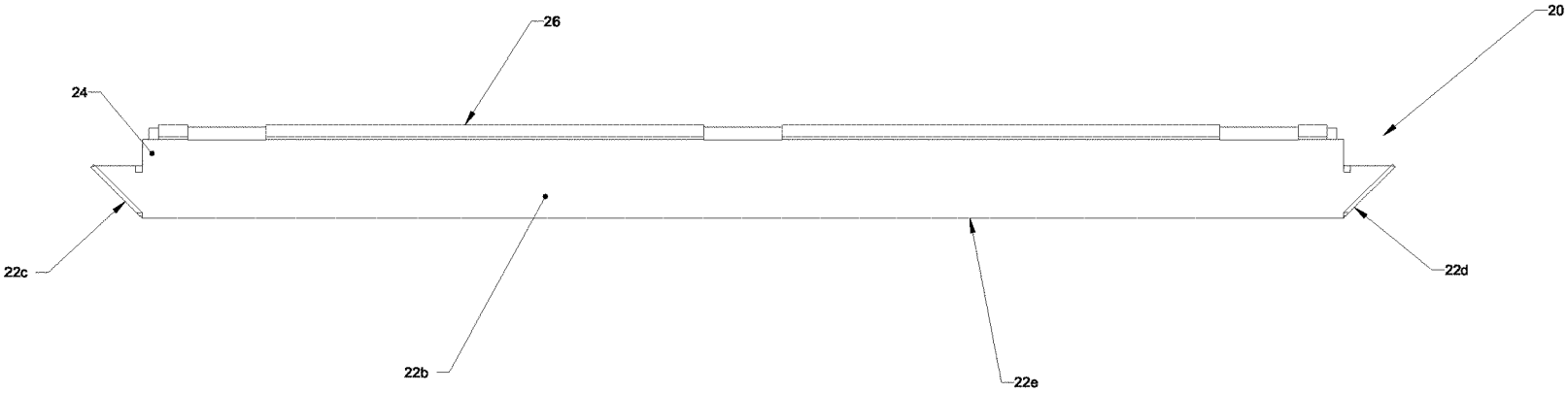
FIG. 3 shows a back view of a bullet fragment collection tray.
Figure 4:
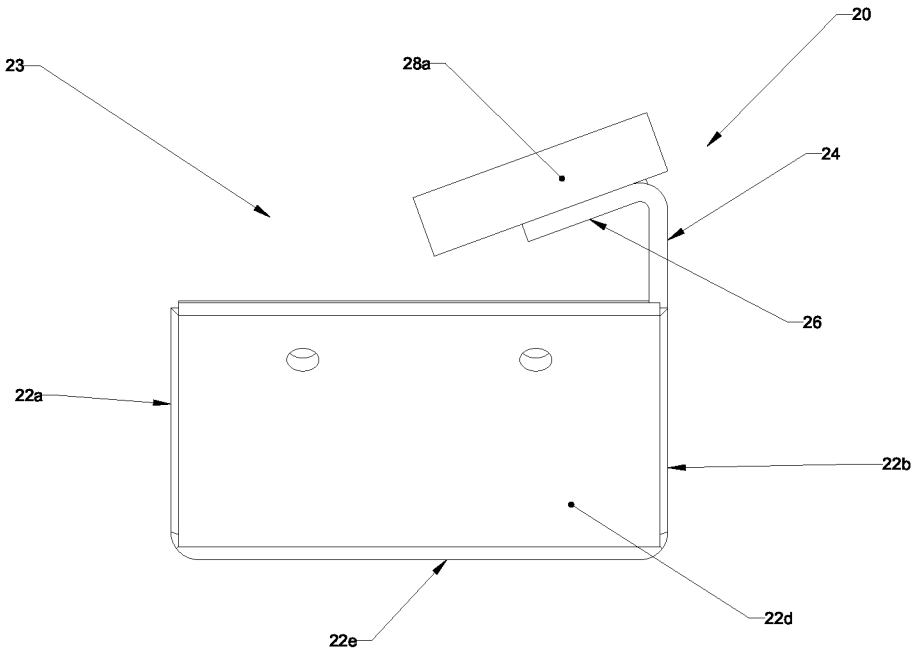
FIG. 4 shows a side view of a bullet fragment collection tray.
Figure 5:
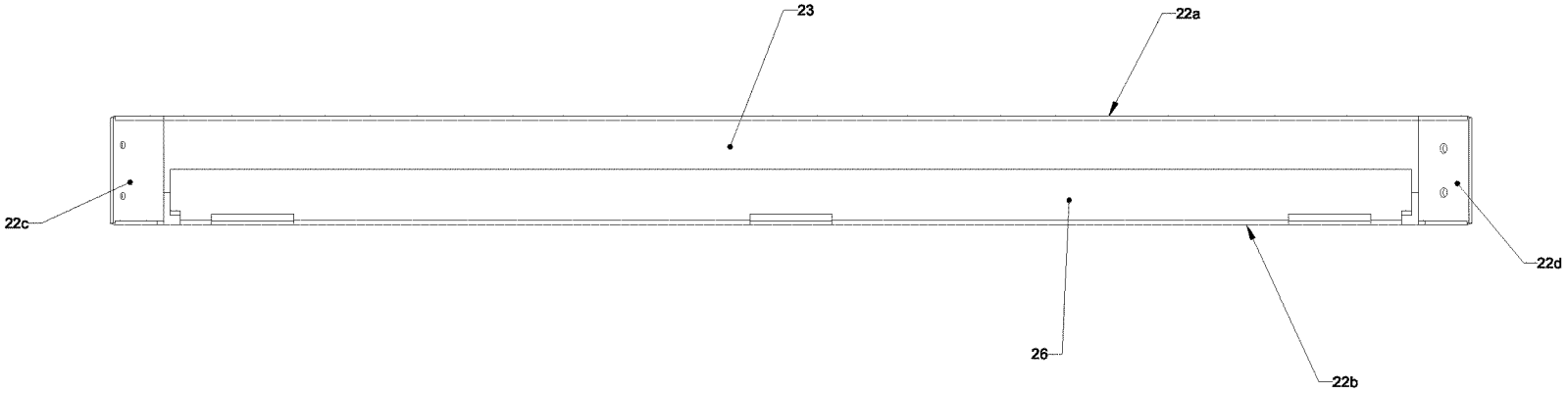
FIG. 5 shows a top view of bullet fragment collection tray.
Figure 6:
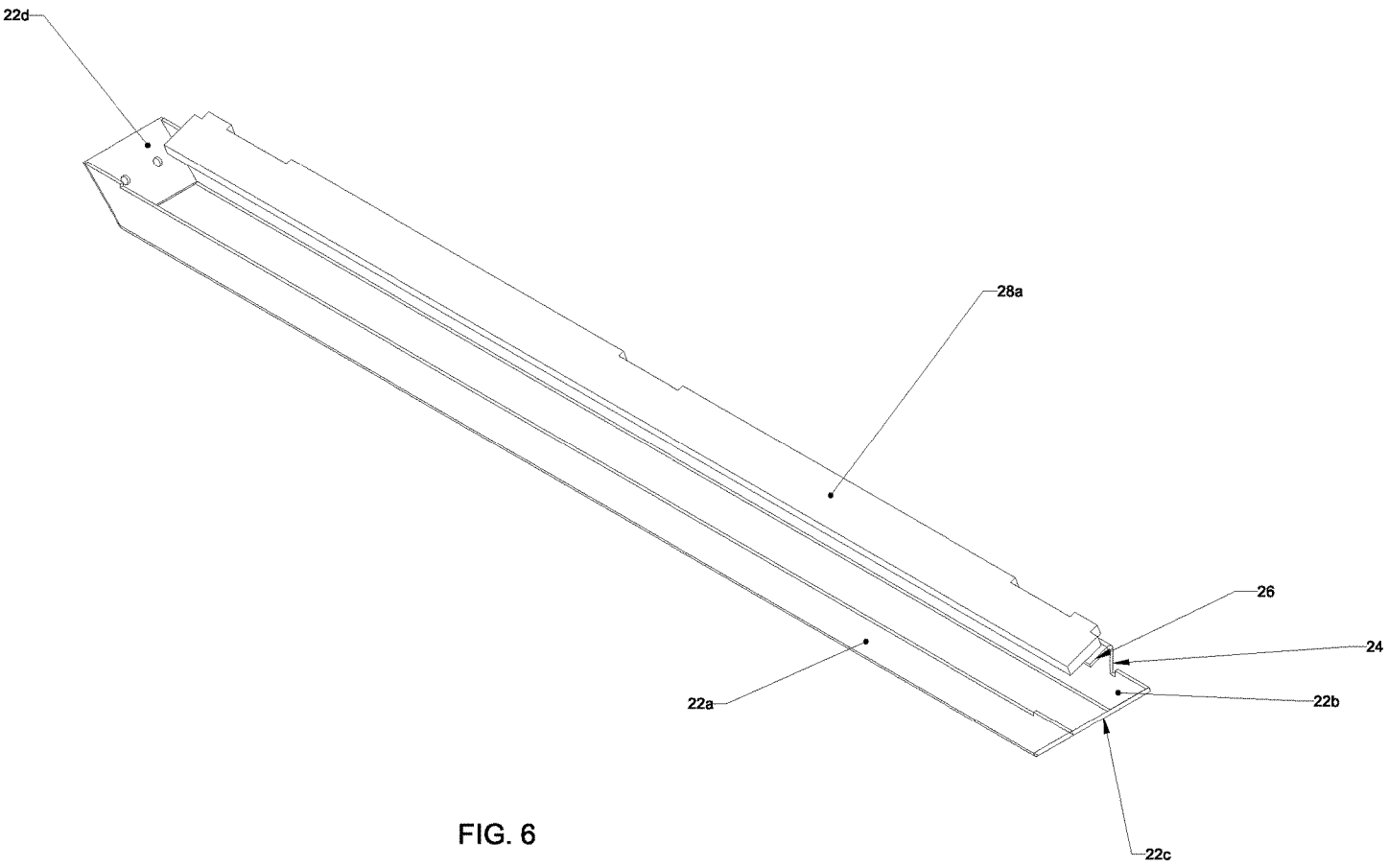
FIG. 6 shows a perspective view of a bullet fragment collection tray.
Figure 7:
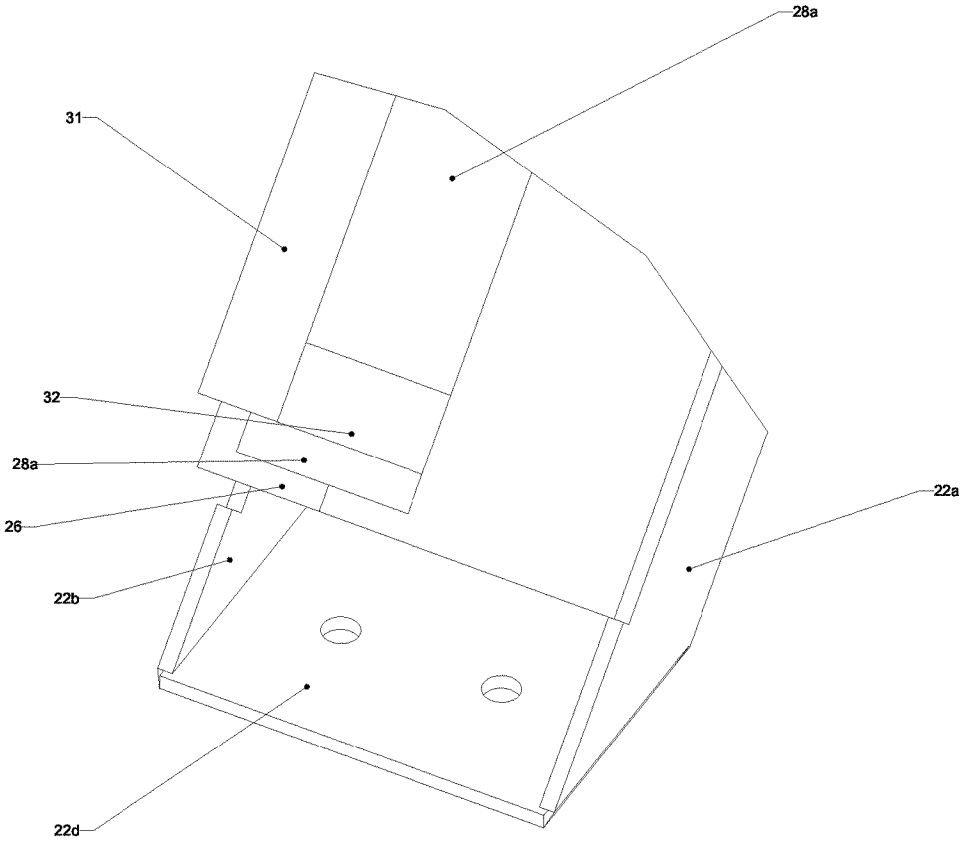
FIG. 7 shows a perspective cutaway view of one end of a bullet fragment collection tray.
Figure 8:
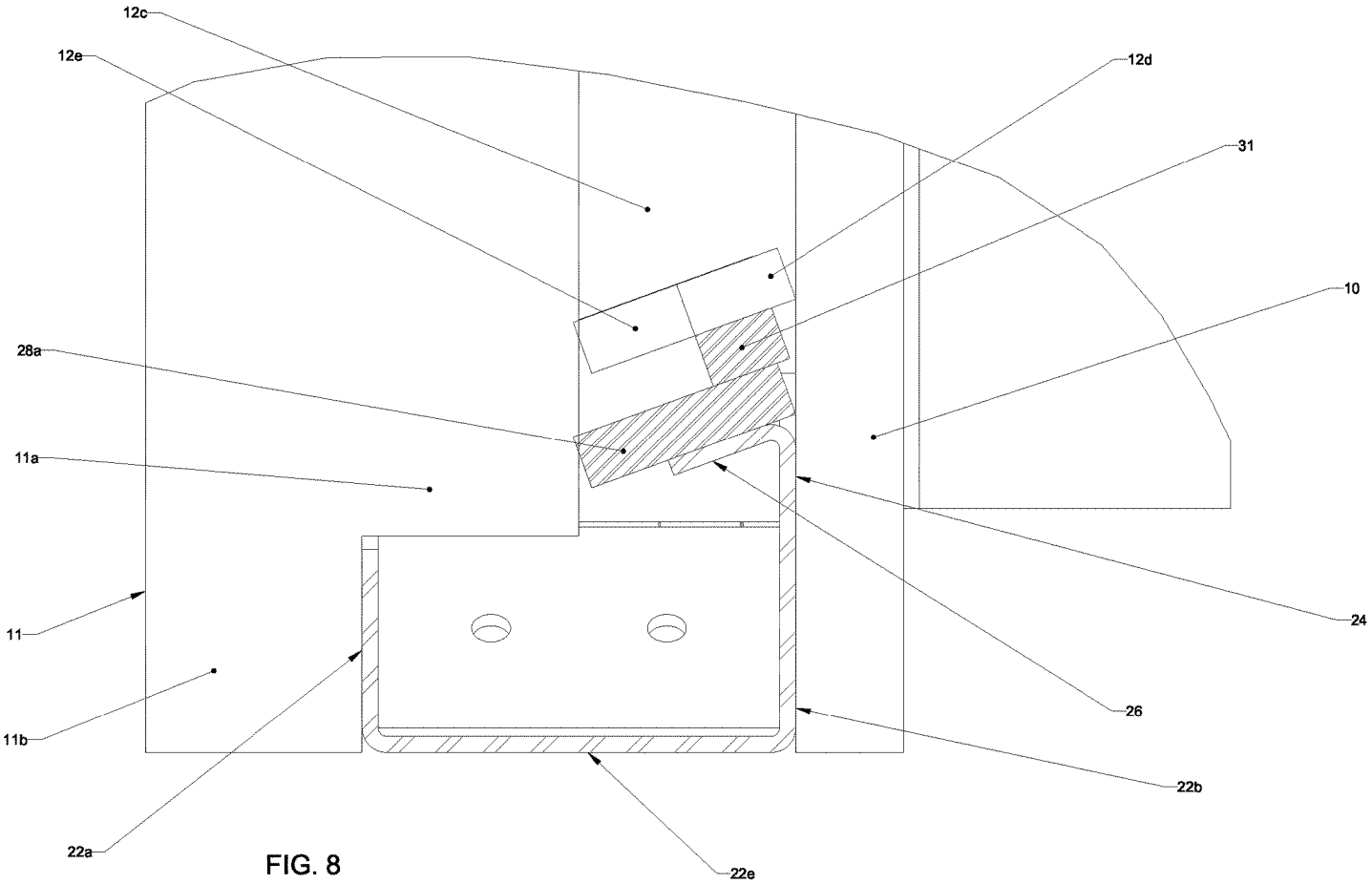
FIG. 8 shows a side view of a bullet fragment collection tray connected to a bullet trap having a self-sealing resilient panel and a back plate.

FIGS. 3-7 show various aspects of a bullet fragment collection tray. Specifically, FIG. 3 shows a back view of a bullet fragment collection tray 20 having a bottom 22*e*, a rear side 22*b* which extends up and forms a top plate extension support 24 that is bent to form the top plate 26. Also shown in FIG. 3 are the first end 22*c*, second end 22*d*, which are both angled upwardly and outwardly from the bottom 22*e*, so as to form an angled side that can facilitate sliding of bullet fragments out of the bullet fragment collection tray when it is lowered. FIG. 5 shows a top view of the same elements shown in FIG. 3.

FIG. 4 shows an end view of a bullet fragment collection tray 20, having a top plate 26 covering a portion of the top opening 23 of the collection tray. The top plate 26 may be formed by extending the back side 22*b* of the collection tray to form the top plate extension support 24, which is bent forwardly to form a forward extending lip that constitutes the top plate 26. The top plate 26 is shown angled downwardly from the rear side toward and terminating at a middle portion of the bullet fragment collection tray 20. Also shown in FIG. 4 is a heavy duty shield plate 28*a* covering the top plate, which protects the top plate 26 from bullet impacts. FIG. 6 shows a perspective view of the bullet fragment collection tray 20 of FIGS. 3-5.

FIG. 7 shows a more detailed perspective view of one end of a bullet trap collection tray according to FIGS. 3-6. In particular, FIG. 7 shows gaskets 31 and 32, which are placed on top of the shield plate 28*a*. Gasket 31 is placed toward the rear of the shield plate 28*a* and gasket 32 is placed at both ends of the shield plate 28*a*.

Figure 9:
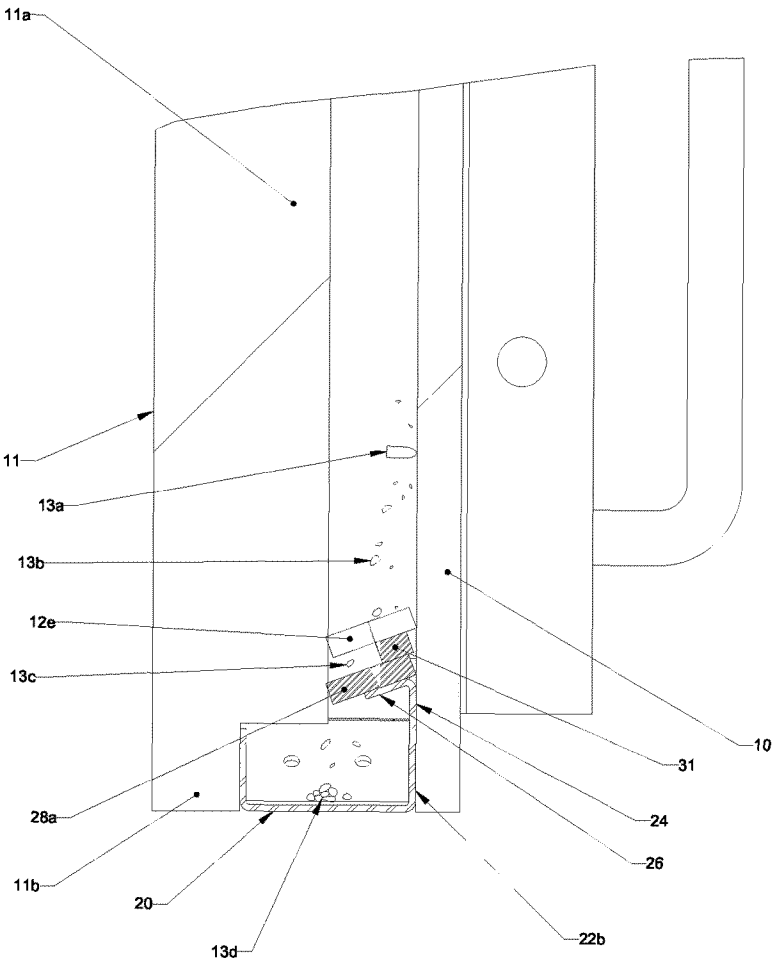
FIG. 9 shows a side view of a bullet fragment collection tray connected to and under a bullet trap having a self-sealing resilient panel and a back plate, showing bullet fragments that have penetrated the resilient panel, are inside the bullet trap and falling into the bullet fragment collection tray.

FIGS. 8 and 9 show more detailed side views of the bullet fragment collection tray 20, together and in connection with the bullet trap. FIGS. 8 and 9 show side views of the back plate 10 with a self-sealing resilient panel 11 mounted to the front of the back plate. FIG. 9 also illustrates bullet fragments 13 that have penetrated the self-sealing resilient panel 11 and are accumulating behind the self-sealing resilient panel 11, and then dropping between the back plate 10 and the resilient panel 11 through the opening 12*e* at the bottom.

Also shown in FIG. 9 is the bullet fragment collection tray 20 mounted beneath the back plate 10. FIGS. 8 and 9 show the bullet fragment collection tray 20 with a resilient gasket 31 disposed on top of the shield plate 28*a* and configured to form a seal between the bullet fragment tray and the bullet trap.

In particular, FIGS. 8 and 9 show top plate 26 and shield 28*a* (covering and protecting the top plate from bullet impacts) extends forward to cover a rear portion of the bullet fragment tray, leaving a front portion of the bullet fragment tray open, forming the opening 23. Because the self-sealing resilient panel extends rearwardly and abuts against the top plate 26 and shield 28*a*, the resilient panel also completely covers the opening 23 into the bullet fragment tray. Thus, during operation, there is no hole or opening through which bullet fragments can freely fall into the bullet fragment collection tray. Instead, bullet fragments fall through the opening 12*e* of the bottom edge shield 12*d*, onto the top of the top plate edge shield 28*a*, where they are then trapped by the seal between the resilient panel 11 and top plate edge shield 28*a*, thereby preventing the bullet fragments from falling into the collection tray. However, when the bullets impact the bullet trap the resilient panel 11 will flex away from the edge shield 12*d* and top plate shield 28*a* due to the concussion of the impact to create an opening between the resilient panel 11 and the shield 28*a*. Thus, bullets 13*a* pierce the resilient panel and enter target where they impact the back plate and are broken into fragments 13*b*, which fall to the top edge of the edge shield 12*d* or through the edge shield opening 12*e* directly onto the shield 28*a* that is mounted to the top plate 26, where they collect and eventually fall through the opening and into the tray where they collect into a pile 13*d*. This configuration limits the amount of the tray that is exposed to high velocity bullet fragments that may harm the tray. In this embodiment, the self-sealing resilient panel 11 fully covers and seals the front side of the back plate within the perimeter of the edge shield 12*a*, 12*b*, 12*c*, and 12*d* and the shield plate 28*a* of the top plate of the bullet fragment collection tray, wherein the self-sealing resilient panel and shield plate form a resilient seal that is configured to allow bullet fragments to pass through upon concussion of the bullet trap with a bullet and resulting disruption of the resilient seal to allow bullet fragments to pass through the disrupted seal.

Figure 10:
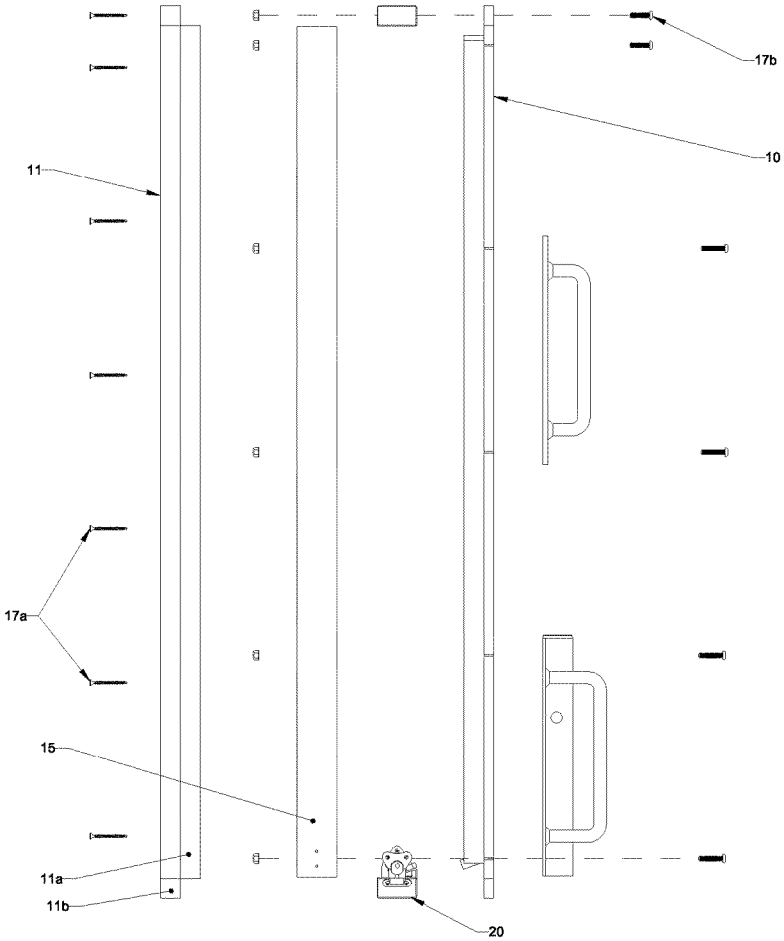
FIG. 10 shows an exploded side view of a bullet trap having a self-sealing resilient panel, a perimeter channel, and a back plate, under which is mounted a bullet fragment collection tray.

FIG. 10 shows an exploded side view of a bullet trap having a self-sealing resilient panel 11, a perimeter channel 15, and a back plate 10, under which is mounted a bullet fragment collection tray 20. The self-sealing resilient panel 11 has a thicker internal portion 11*a*, with thinner edges 11*b*. The self-sealing resilient panel 11 is mounted by means of fasteners, such as screws 17*a*, to the perimeter channel 15, which provides a support structure for the resilient panel and which can also be mounted to the back plate 10 by means of fasteners, such as bolts/nuts 17*b*. As shown previously in FIGS. 8 and 9, the self-sealing resilient panel 11 has a thinner edge 11*b* that covers the bullet fragment collection tray, and a thicker internal portion 11*a* that abuts against the front edge of the bottom edge shield 12*e* and top plate shield 28*a*, thereby covering the top opening 23 of the collection tray. The self-sealing resilient panel 11 is mounted to the perimeter channel 15, which may be a C-shaped channel that will allow bolting of the front edge of the perimeter channel to the resilient panel and bolting of the rear edge of the perimeter channel to be bolted to the outer edge of the back plate.

Figure 11:
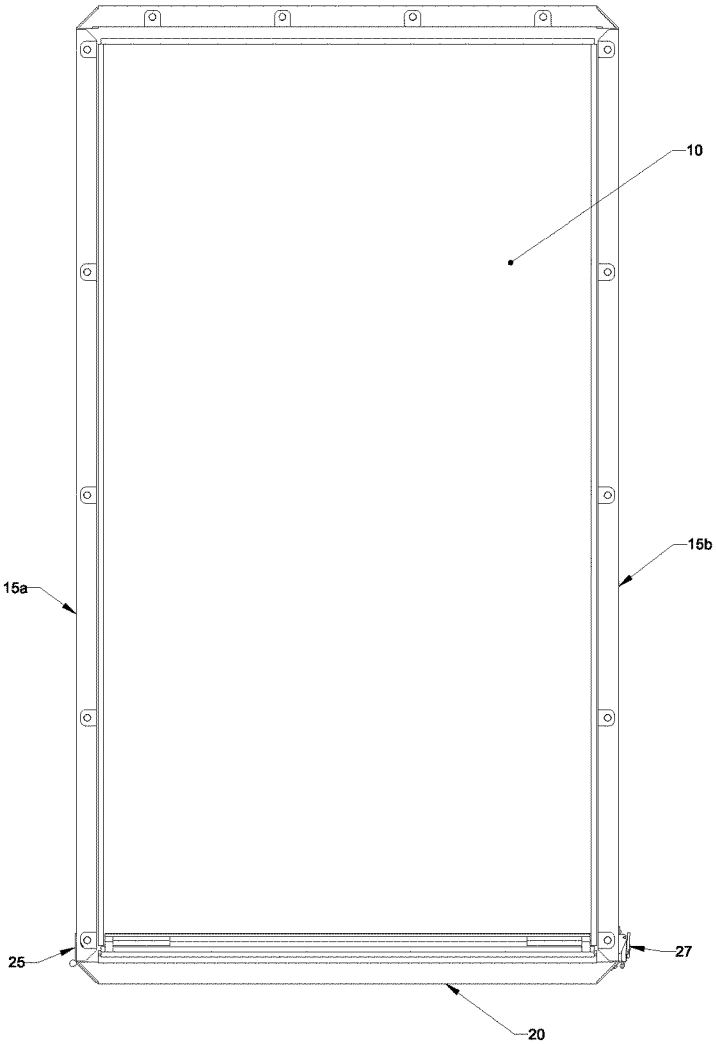
FIG. 11 shows a front view of a bullet trap, with the bullet fragment collection tray mounted underneath in a latched position.
Figure 12:
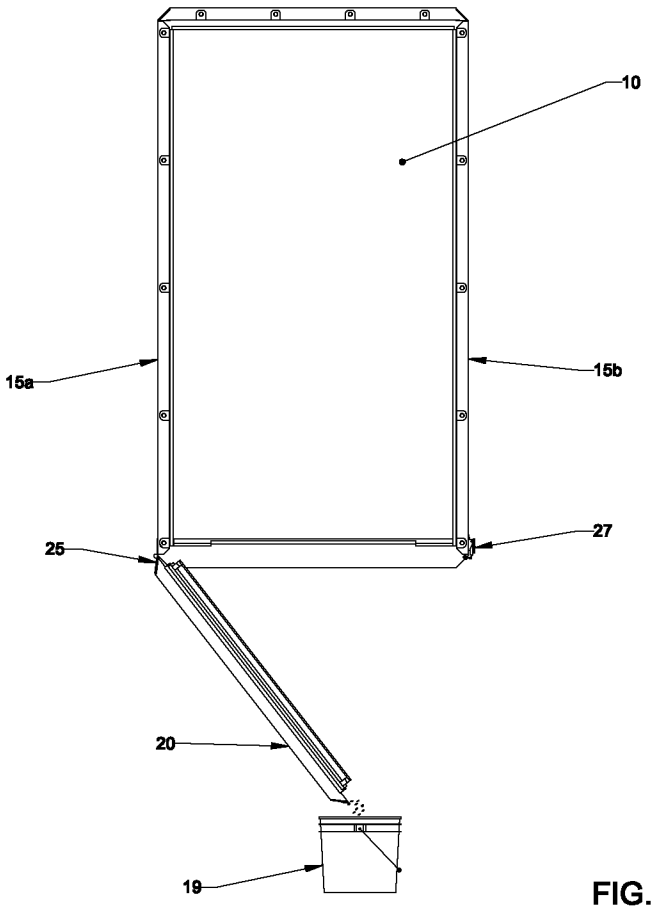
FIG. 12 shows a front view of a bullet trap, with the bullet fragment collection tray mounted underneath in an unlatched and lowered position, with bullet fragments inside the collection tray being disposed in a bucket.

FIG. 11 shows a front view of a bullet trap (shown without the resilient panel 11, for clarity), with the bullet fragment collection tray 20 mounted underneath the bullet trap 10 in a latched position. A left perimeter channel 15*a* is shown, to which is attached the hinge 25. A right perimeter channel 15*b* is shown, to which is attached the releasable latch 27.

FIG. 12 shows the same front view of a bullet trap of FIG. 11 (shown without the resilient panel 11, for clarity), with the bullet fragment collection tray mounted underneath in an unlatched and lowered position, with bullet fragments inside the collection tray being disposed in a bucket 19.

Figure 13:
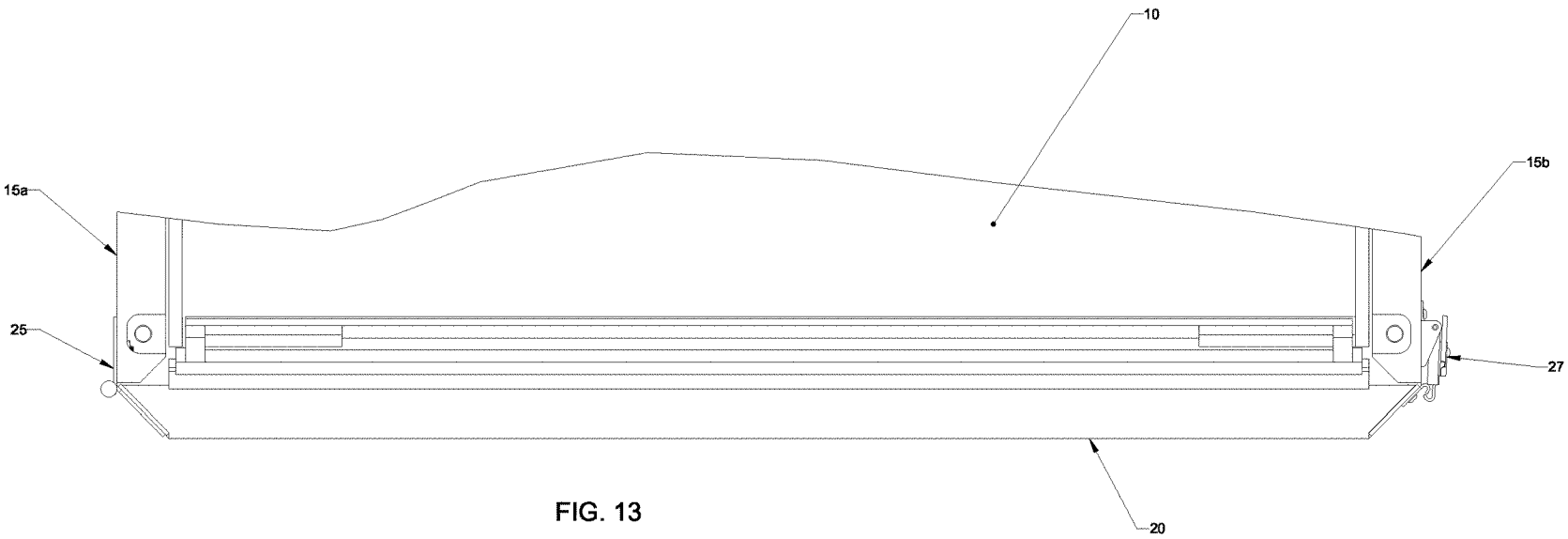
FIG. 13 shows an enlarged view of the latched bullet fragment collection tray of FIG. 12.
Figure 14:
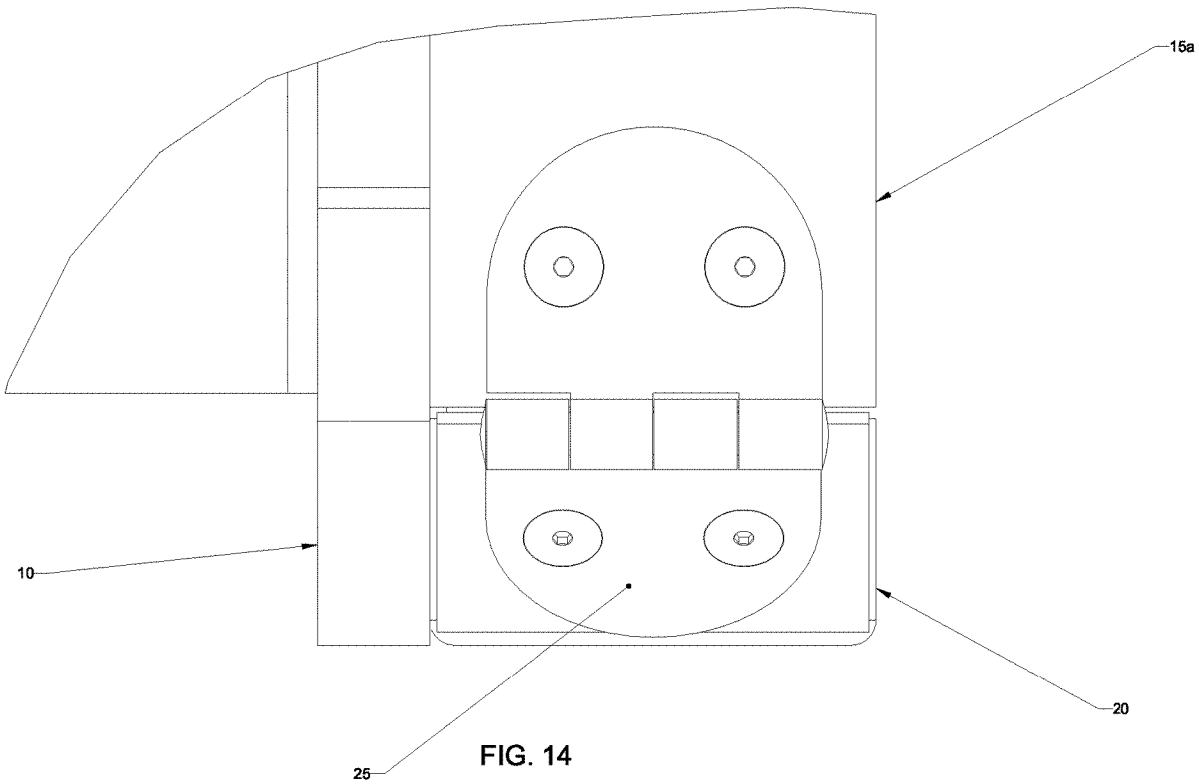
FIG. 14 shows a view of the bullet fragment collection tray hinge connecting the bullet fragment collection tray to the perimeter channel.
Figure 15:
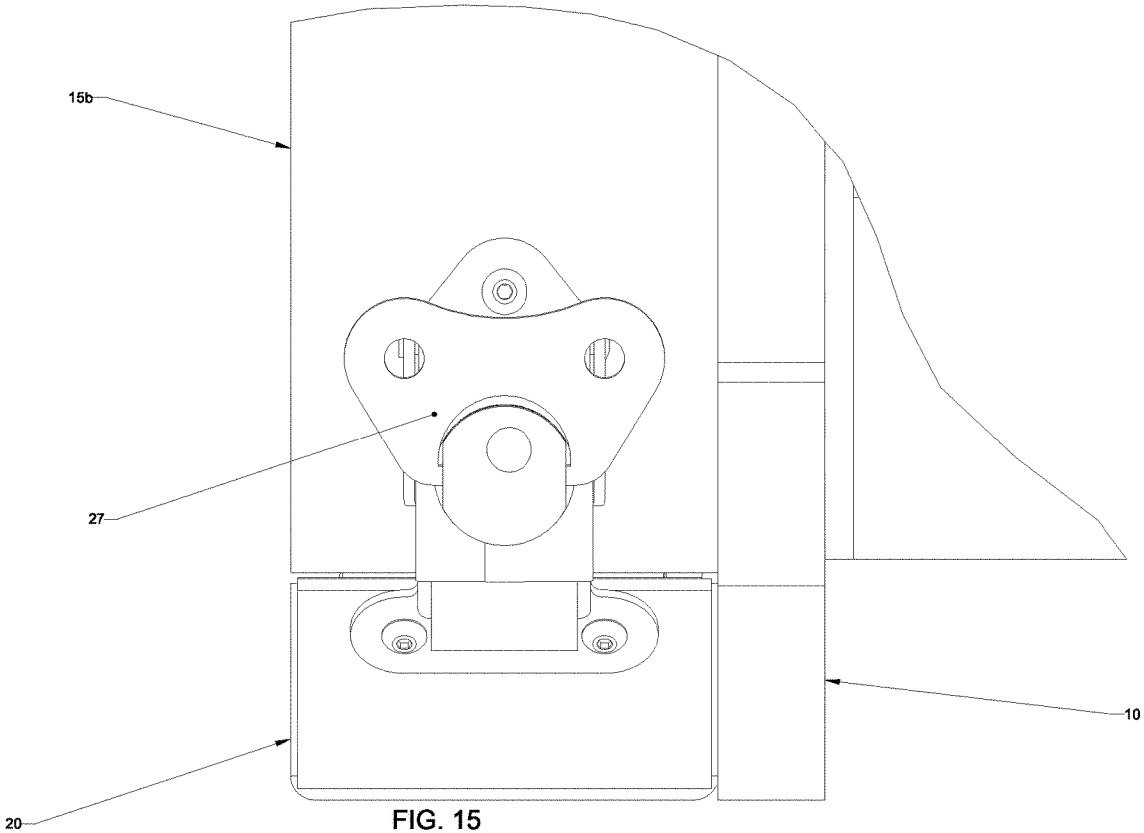
FIG. 15 shows a view a bullet fragment collection tray latch connecting the bullet fragment collection tray to the perimeter channel.

FIG. 13-15 show enlarged views of the bullet fragment collection tray of FIG. 12. In particular, FIG. 13 shows hinge 25 connected to the left perimeter channel 15*a* and the bullet fragment collection tray 20. FIG. 14 shows an end view of the hinge 25 connected to the left perimeter channel 15*a* and the bullet fragment collection tray 20. FIG. 15 shows latch 27 connected to the right perimeter channel 15*b* and the bullet fragment collection tray 20.

Thus, there is disclosed an improved bullet trap. Those skilled in the art will appreciate numerous modifications which can be made without departing from the scope and spirit of the present invention. The appended claims are intended to cover such modifications.

The invention claimed is:

1. A bullet trap for trapping and collecting bullet fragments, comprising a bullet fragment collection tray mounted to a bottom of the bullet trap beneath a bullet fragment exit, wherein the bullet fragment collection tray is mounted via a hinge at a first end, has a releasable latch at a second end and has a top opening configured to receive bullet fragments, and wherein the bullet fragment collection tray further comprises a top plate extends to cover a portion of the bullet fragment collection tray, and further comprising a shield plate covering at least a portion of the top plate that is exposed to bullet impacts and wherein the bullet fragment collection tray further comprises a resilient gasket disposed on the shield plate and configured to form a seal between the bullet fragment tray and the bullet trap.

2. The bullet trap according to claim 1, wherein the second end of the bullet fragment tray has a side that is angled outwardly to facilitate sliding of bullet fragments out of the second end of the bullet fragment collection tray when the releasable latch is released and the second end is lowered.

3. The bullet trap according to claim 1, wherein the shield plate covers the top plate and extends beyond the top plate.

4. The bullet trap according to claim 3, wherein the bullet trap further comprises a self-healing resilient panel and wherein the shield plate extends to an engagement with the self-sealing resilient panel and is sloped downwardly toward the self-sealing resilient panel such that bullet fragments are held on the shield plate until the bullet trap is struck by a bullet such that the self-sealing panel and the shield plate are distended away from one another.

5. A bullet trap for trapping and collecting bullet fragments, comprising:

a back plate having a perimeter and front side;

a first edge shield disposed on the front side of and around the perimeter of the back plate and having a bottom portion configured with an opening to allow bullet fragments to drop past the edge shield;

a self-sealing resilient panel covering at least a portion of the front side of the back plate within the perimeter of the edge shield, wherein the space between the back plate, edge shield and self-sealing resilient panel defines a bullet fragment collection chamber having a bottom opening through which bullet fragments trapped in the bullet fragment collection chamber may exit;

a bullet fragment collection tray mounted beneath and extending along the bottom portion of the edge shield, wherein the collection tray comprises a bottom, a front side, a back side, a first end, a second end, and a top opening for receiving bullet fragments and a second edge shield disposed below the opening in the bottom portion of the first edge shield to collect projectiles passing through the opening.

6. The bullet trap according to claim 5 wherein the second end of the collection tray has a side that is angled outwardly to facilitate sliding of bullet fragments out of the second end of the collection tray when the second end is lowered.

7. The bullet trap according to claim 5, further comprising a resilient gasket disposed between and abutting the bullet fragment collection tray and one or more of the back plate and first edge shield.

8. The bullet trap according to claim 7, wherein the bottom portion of the first edge shield is angled downwardly from the back plate toward a middle portion of the bullet fragment tray so as to direct bullet fragments into the bullet fragment collection tray.

9. The bullet trap according to claim 5, wherein the bullet fragment collection tray further comprises a top plate covering a portion of the top opening and angled downwardly toward and terminating at a middle portion of the bullet fragment collection tray.

10. The bullet trap according to claim 9, wherein the second edge shield covers a top portion of the top plate.

11. The bullet trap according to claim 10, wherein the top plate is connected to the second edge shield and extends from the back side to a middle portion of the bullet fragment collection tray.

12. The bullet trap according to claim 5 further comprising a perimeter channel configured to be mounted to the self-sealing resilient panel and to the back plate.

13. The bullet trap according to claim 12, wherein a bullet fragment tray hinge is mounted to the perimeter channel.

14. The bullet trap according to claim 5, wherein the self-sealing resilient panel fully covers and seals the front side of the back plate within the perimeter of the edge shield and the shield plate of the top plate of the bullet fragment collection tray, wherein the self-sealing resilient panel and shield plate form a resilient seal that is configured to allow bullet fragments to pass through upon concussion of the bullet trap with a bullet and resulting disruption of the resilient seal.

15. The bullet trap according to claim 5 wherein the second edge shield extends to an engagement with the self-sealing resilient panel such that bullet fragments are held on the second edge shield until the bullet trap is struck by a bullet such that the self-sealing panel and the second edge shield are distended away from one another.

16. A bullet trap for trapping and collecting bullet fragments, comprising a bullet fragment collection tray mounted to a bottom of the bullet trap beneath a bullet fragment exit, wherein the bullet fragment collection tray is mounted via a hinge at a first end, has a releasable latch at a second end and has a top opening configured to receive bullet fragments, and wherein the bullet fragment collection tray further comprises a top plate extends to cover a portion of the bullet fragment collection tray, and further comprising a resilient gasket configured to form a seal between the bullet fragment tray and the bullet trap.

17. The bullet trap according to claim 16, further comprising a shield plate disposed to cover the top plate and extend beyond the top plate.

18. The bullet trap according to claim 17 wherein the bullet trap comprises a back plate having a perimeter and front side;

a first edge shield disposed on the front side of and around the perimeter of the back plate and having a bottom portion configured with an opening to allow bullet fragments to drop past the edge shield;

a self-sealing resilient panel covering at least a portion of the front side of the back plate within the perimeter of the edge shield, wherein the space between the back plate, edge shield and self-sealing resilient panel defines a bullet fragment collection chamber having a bottom opening through which bullet fragments trapped in the bullet fragment collection chamber may exit;

and further comprising a back plate and wherein the shield plate extends to an engagement with the self-sealing resilient panel and is sloped downwardly toward the self-sealing resilient panel such that bullet fragments are held on the shield plate until the bullet trap is struck by a bullet such that the self-sealing panel and the shield plate are distended away from one another.

19. The bullet trap according to claim 18 further comprising a perimeter channel configured to be mounted to the self-sealing resilient panel and to the back plate.

20. The bullet trap according to claim 19, wherein the bullet fragment tray hinge is mounted to the perimeter channel.

* * * * *